US006896785B2

(12) United States Patent
Shatrov et al.

(10) Patent No.: US 6,896,785 B2
(45) Date of Patent: May 24, 2005

(54) PROCESS AND DEVICE FOR FORMING CERAMIC COATINGS ON METALS AND ALLOYS, AND COATINGS PRODUCED BY THIS PROCESS

(75) Inventors: Alexander Sergeevich Shatrov, Cherry Hinton (GB); Victor Iosifovich Samsonov, Great Abington (GB)

(73) Assignee: Isle Coat Limited, Isle of Man (GB)

( * ) Notice: Subject to any disclaimer, the term of this patent is extended or adjusted under 35 U.S.C. 154(b) by 45 days.

(21) Appl. No.: 10/123,010

(22) Filed: Apr. 15, 2002

(65) Prior Publication Data

US 2003/0188972 A1 Oct. 9, 2003

(30) Foreign Application Priority Data

Mar. 27, 2002 (GB) ..... 0207193

(51) Int. Cl.[7] ..... C25D 15/00

(52) U.S. Cl. ..... 205/109; 205/148; 205/316; 205/333; 204/164

(58) Field of Search ..... 205/109, 148, 205/316, 333; 204/164

(56) References Cited

U.S. PATENT DOCUMENTS

| | | | | |
|---|---|---|---|---|
| 4,316,786 | A | 2/1982 | Yu et al. | |
| 4,364,802 | A | 12/1982 | Inoue | |
| 5,185,073 | A | 2/1993 | Bindra et al. | |
| 5,275,714 | A | 1/1994 | Bonnet et al. | |
| 5,616,229 | A | 4/1997 | Samsonov et al. | |
| 5,705,230 | A | 1/1998 | Matanabe et al. | |
| 6,083,356 | A * | 7/2000 | Goedicke et al. | 204/164 |
| 6,197,178 | B1 * | 3/2001 | Patel et al. | 205/81 |
| 6,365,028 | B1 | 4/2002 | Shatrov | |
| 6,808,613 | B2 * | 10/2004 | Beauvir | 205/106 |
| 2001/0045360 | A1 | 11/2001 | Omasa | |
| 2003/0052011 | A1 * | 3/2003 | Chen | 205/80 |

FOREIGN PATENT DOCUMENTS

| | | |
|---|---|---|
| DE | 151330 | 10/1981 |
| EP | 1041178 | 4/2000 |
| EP | 1164208 | 12/2001 |
| GB | 2237030 | 4/1991 |
| JP | 59-89782 | 5/1984 |
| JP | 1-159394 | 6/1989 |
| JP | 1-172588 | 7/1989 |
| JP | 2-30790 | 2/1990 |
| JP | 2-305991 | 12/1990 |
| RU | 2038428 | 6/1995 |
| RU | 2043911 | 9/1995 |
| RU | 2070942 | 12/1996 |
| RU | 2077612 | 4/1997 |
| SU | 1767043 | 7/1992 |
| WO | WO 96/38603 | 12/1996 |
| WO | WO 97/03231 | 1/1997 |
| WO | WO 97/39167 | 10/1997 |

* cited by examiner

*Primary Examiner*—Roy King
*Assistant Examiner*—William T. Leader
(74) *Attorney, Agent, or Firm*—Garvey, Smith, Nehrbass & Doody, L.L.C.; Seth M. Nehrbass; Brett A. North

(57) ABSTRACT

There is disclosed a process and apparatus for carrying out plasma electrolytic oxidation of metals and alloys, forming ceramic coatings on surfaces thereof at a rate of 2–10 microns per minute. The process comprises the use of high-frequency current pulses of a certain form and having a given frequency range, combined with the generation of acoustic vibrations in a sonic frequency range in the electrolyte, the frequency ranges of the current pulses and the acoustic vibrations being overlapping. The process makes it possible to introduce ultra-disperse powders into the electrolyte, with the acoustic vibrations helping to form a stable hydrosol, and to create coatings with set properties. The process makes it possible to produce dense hard micro-crystalline ceramic coatings of thickness up to 150 microns. The coatings are characterised by reduced specific thickness of an external porous layer (less than 14% of the total coating thickness) and low roughness of the oxidised surface, Ra 0.6–2.1 microns.

16 Claims, 2 Drawing Sheets

PROCESS AND DEVICE FOR FORMING CERAMIC COATINGS ON METALS AND ALLOYS, AND COATINGS PRODUCED BY THIS PROCESS

CROSS-REFERENCE TO RELATED APPLICATIONS

Priority of UK Patent Application Serial No. 0207193.4 filed in the name of Isle Coat Limited on 27 Mar. 2002, incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND

The invention relates to the field of applying protective coatings, and in particular to plasma discharge, for example plasma-electrolytic oxidation, coating of articles made of metals and alloys. This process makes it possible rapidly and efficiently to form wear-resistant, corrosion-resistant, heat-resistant, dielectric uniformly-coloured ceramic coatings on the surfaces of these articles.

The coatings are characterised by a high degree of uniformity of thickness, low surface roughness and the virtual absence of an external porous layer, the removal of which usually involves considerable expense in conventional coating processes.

The process for producing the coatings and the device for implementing the process, described in this application, can be used in engineering, the aircraft and motor vehicle industries, the petrochemical and textiles industries, electronics, medicine and the production of household goods.

A process for producing a ceramic coating using industrial-frequency 50–60 Hz current is known from WO 99/3 1303. The process enables hard coatings of thickness up to 200 $\mu$m, well-bonded to the substrate, to be formed on the surface of articles made from aluminium alloys.

The main problem with this process is the formation of a considerable external porous layer of low microhardness and with numerous micro- and macro-defects (pores, microcracks, flaky patches). The thickness of the defective layer amounts to 25–55% of the total thickness of the ceramic coating, depending on the chemical composition of the alloy being processed and on the electrolysis regimes.

Expensive precision equipment is used to remove the porous layer. If the article is of complex shape, with surfaces that are difficult for abrasive and diamond tools to reach, the problem of removing the defective layer becomes difficult to solve. This limits the range of application of the process.

Other problems with the known process are the relatively low rate at which the coating forms and the high energy consumption. It is not possible to increase the productivity of the oxidation process simply by raising the current density to higher than 20 A/dm$^2$, since the process then becomes an arc process rather than a spark one; and due to the appearance of strong local burn-through discharges, the whole coating becomes very porous and flaky and adhesion to the substrate deteriorates.

With the aim of intensifying the oxidation process and improving the characteristics of the ceramic coatings, many researchers have tried to improve the electrolysis pulse regimes, proposing different forms and durations of current or voltage pulses.

A process for forming ceramic coatings where the current has a modified sine wave form is known from U.S. Pat. No. 5,616,229. This form of current reduces heat stresses in forming the ceramic layer and enables coatings of thickness up to 300 $\mu$m to be applied. However, industrial frequency current is used in this process, which leads to the formation of a relatively thick external porous layer with high surface roughness and relatively high energy costs.

There is another known process, RU 2077612, for oxidising valve metals and alloys in a pulsed anode-cathode regime, in which positive and negative pulses of a special complex form alternate. The duration of the pulses and of the pause between a positive pulse and a negative one is 100–130 $\mu$sec, and the succession frequency is 50 Hz. In the first 5–7 $\mu$sec, the current reaches its maximum (up to 800 A/dm$^2$), after which it remains constant for 25–50 $\mu$sec. In this case, the shorter pulses and far greater pulse powers enable the discharge ignition time to be reduced considerably, and the main reasons for the formation of the defective outer layers are eliminated. However, the pairs of powerful pulses alternate with unjustifiably long pauses, which leads to a low coating formation rate.

There is also a known process, SU 1767043, for producing oxide coatings in an alkaline electrolyte using positive pulses of voltage, amplitude 100–1000V. These pulses have a two-stage form. Initially, for 1–3 $\mu$sec, the voltage rises to maximum, and then falls to about a tenth of this, continuing at a constant level for 10–20 $\mu$sec. However, the use of positive pulses alone does not make it possible to produce good-quality coatings with high microhardness and wear resistance.

The closest prior art to the proposed invention is the process described in RU 2070942 for oxidation using alternating positive and negative pulses of voltage, amplitude 100–500V and duration 1–10 $\mu$sec, during which, at each of the anode half-periods, high-voltage positive pulses, amplitude 600–1000V and duration 0.1–1 $\mu$sec, are also applied. When the pulses are applied, the total current at that moment rises, which creates favourable conditions for discharges. The problem with this process is the use of very short high-voltage positive pulses, which does not make it possible to create discharges of sufficient power. This leads to low productivity of the process, and it is also extremely difficult to implement the proposed process technically for industrial purposes.

While certain novel features of this invention shown and described below are pointed out in the annexed claims, the invention is not intended to be limited to the details specified, since a person of ordinary skill in the relevant art will understand that various omissions, modifications, substitutions and changes in the forms and details of the device illustrated and in its operation may be made without departing in any way from the spirit of the present invention. No feature of the invention is critical or essential unless it is expressly stated as being "critical" or "essential."

BRIEF SUMMARY

According to a first aspect of the present invention, there is provided a process for forming ceramic coatings on metals and alloys in an electrolytic bath fitted with a first electrode and filled with aqueous alkaline electrolyte, in which is immersed the article, connected to another electrode, wherein a pulsed current is supplied across the electrodes so as to enable the process to be conducted in a plasma-discharge regime, the process comprising the steps of:

i) supplying the electrodes with high-frequency bipolar pulses of current having a predetermined frequency range; and ii) generating acoustic vibrations in the electrolyte in a predetermined sonic frequency range so that the frequency range of the acoustic vibrations overlaps with the frequency range of the current pulses.

According to a second aspect of the present invention, there is provided an apparatus for forming a ceramic coating on metals and alloys, the apparatus including an electrolytic bath with electrodes, a supply source for sending pulsed current to the electrodes, and at least one acoustic vibration generator, wherein:

i) the supply source is adapted to supply the electrodes with high-frequency bipolar pulses of current having a predetermined frequency range; and ii) the at least one acoustic vibration generator is adapted to generate acoustic vibrations in an electrolyte when contained in the bath, the acoustic vibrations having a predetermined sonic frequency range that overlaps with the frequency range of the current pulses.

According to a third aspect of the present invention, there is provided a ceramic coating formed by the process or apparatus of the first or second aspects of the present invention.

According to a fourth aspect of the present invention, there is provided a ceramic coating formed on a metal or alloy by way of a plasma-discharge process, the coating having an external porous layer comprising not more than 14% of a total coating thickness.

According to a fifth aspect of the present invention, there is provided a ceramic coating formed on a metal or alloy by way of a plasma-discharge process, the coating having a surface with a low roughness (Ra) of 0.6 to 2.1 $\mu$m.

The bipolar current pulses may be alternating pulses, or may be supplied as packets of pulses, for example comprising two of one polarity followed by another of opposed polarity.

Embodiments of the present invention seek to improve the useful properties of ceramic coatings such as resistance to wear, corrosion and heat, and dielectric strength, by improving the physico-mechanical characteristics of the coatings. Embodiments of the invention also solve the technical problem of producing hard microcrystalline ceramic coatings with good adhesion to a substrate.

Embodiments of the invention also seek to improve the technical sophistication of the process of forming ceramic coatings by significantly reducing the time it takes to apply the coating itself, and the time spent in the finishing treatment thereof. Not only is the productivity of the oxidation process raised, but specific power costs are also significantly reduced.

Embodiments of the invention additionally provide for the targeted formation of coatings with set properties by introducing refractory inorganic compounds into the electrolyte.

Embodiments of the invention may also raise the stability of the electrolyte and increase its useful life.

Embodiments of the apparatus of the present invention seek to provide improved reliability, versatility and ease of building into automated production lines.

Advantageously, an article to be coated is connected to an electrode and placed in an electrolytic bath which has another electrode and which is filled with an alkaline electrolyte. The electrodes may be supplied with pulsed current so as to form a coating of a required thickness in a plasma-discharge regime, which is preferably a plasma electrolytic oxidation regime. Pulsed current may be created in the bath with a pulse succession frequency of 500 Hz or more, preferably 1000 to 10,000 Hz, with a preferred pulse duration of 20 to 1,000 $\mu$sec. Each current pulse advantageously has a steep front, so that the maximum amplitude is reached in not more than 10% of the total pulse duration, and the current then falls sharply, after which it gradually decreases to 50% or less of the maximum. The current density is preferably 3 to 200 A/dm$^2$, even more preferably 10 to 60 A/dm$^2$.

The acoustic vibrations may be generated in the electrolyte by an aerohydrodynamic generator, the generator creating acoustic vibrations in the bath in a sonic frequency range that overlaps with a current pulse frequency range.

Ultra-disperse powders (nanopowders) of oxides, borides, carbides, nitrides, silicides and sulphides of metals of particle size not more than 0.5 $\mu$m may be added to the electrolyte, and a stable hydrosol may be formed with the aid of the acoustic vibrations.

The relatively brief current pulses reduce the discharge spark time, which makes it possible to carry out oxidation at higher current densities of 3 to 200 A/dm$^2$.

Brief pulses with high current values make it possible to create sparks in plasma discharge channels formed in the coating which are considerably higher in power than for low-frequency regimes. The higher temperatures in the plasma discharge channels, along with the more rapid cooling and solidifying of the molten substrate due to decreased micro-volumes, leads to the formation of dense microcrystalline ceramic coatings with a high content of solid high-temperature oxide phases. The microhardness of the coatings may reach 500 to 2100 HV, and the thickness of the external porous layer preferably does not exceed 14% of the total thickness of the coating.

The use of current pulses with a succession frequency of more than 500 Hz and of duration less than 1000 $\mu$sec helps to limit the development of arc discharges which make the coating flaky and porous, and at the same time helps to reduce the specific energy costs for forming the coating. However, as the pulse frequency increases, though the specific energy costs are reduced, losses due to surface and capacitive effects begin to rise. These losses start to become significant at a pulse frequency of more than 10,000 Hz. Furthermore, the use of current pulses with frequency more than 10,000 Hz and duration less than 20 $\mu$sec requires very high power in the pulse to produce good quality coatings, which it is extremely complicated and expensive to implement technically for industrial purposes.

The properties of the plasma discharges themselves in high-frequency pulse regimes differ from those of the discharges obtained for oxidation at conventional industrial frequency (50 or 60 Hz). An increase in the brightness and decrease in the size of the sparks can be observed visually. Instead of sparks moving over the surface being oxidised, numerous sparks are seen to be discharging simultaneously over the entire surface.

The preferred form of the current pulses (FIG. 1) facilitates the uniform initiation and maintenance of plasma discharges over the entire surface of the article. The plasma discharge processes do not require a constant high current value to be maintained. The steep front of the pulse and its rapid build-up to a maximum make possible a radical reduction in discharge initiation time. The current, reduced to 50% or less of the maximum, enables the discharge process to be maintained efficiently.

Furthermore, the steep front of the positive and negative pulses makes it possible rapidly to charge and discharge the capacitive load created both by the electrode system (bath-electrolyte-article), and by the double electric layer on the surface of the article being oxidised (electrolyte-oxide-metal).

In practice, during oxidation, mechanical mixers and aerators may be used to agitate the electrolyte, the aerators doing so by bubbling air or oxygen through the electrolyte. These machines create directed flows of liquid, which level out the concentration and temperature of the electrolyte at the macro level. In this sort of mixing, it is difficult to eliminate dead zones and zones of intensive flow round the surface of the article. Modem systems with mixing nozzles ejecting the electrolyte mix it more effectively, ensuring high flow turbulence. Vibratory and pulsating agitation of the electrolyte may also be used.

There is a known process, EP 1 042 178, for anodising non-ferrous alloys, in which vibratory agitation of the electrolyte is carried out by a vibro-motor and rotating blades, the electrodes being vibrated and rocked and a supply of compressed air being fed through a porous ceramic tube with pore size 10–400 $\mu$m. This enables the anodising process to be conducted at a relatively high current density of 10 to 15 A/dm$^2$, considerably reducing the anodising time. However, this process is not efficient enough for plasma oxidation, since the rate at which relatively large air bubbles form in the electrolyte, and the frequency of the vibrations in the electrolyte, are low. The agitation of the electrolyte and the supply and removal of reagents in the electrode regions take place at the macro level. Furthermore, the technical implementation of this process is difficult from the design point of view.

For such a high energy consumption process as plasma electrolytic oxidation, the most significant role is played by the rates of heat and mass transfer and the conditions of the flow of the agitated liquid at the micro level in the direct vicinity of the surface being treated. Acting acoustically on the electrolyte helps to produce this type of agitation.

WO 96/38603 describes a process for spark oxidation with ultrasonic vibrations acting on the electrolyte. These vibrations facilitate the intensive renewal of the electrolyte in the discharge zone. However, ultrasonic vibrations in a liquid cause degassing and the coalescence of gas bubbles, which float to the surface. Up to 60% of the dissolved gas is separated out from the liquid in the first minute. Furthermore, the high power of the ultrasonic vibrations leads to cavitational surface erosion and destroys the ceramic surface, increasing the number of micro-cracks and pores due to hydraulic shocks as the cavitation bubbles burst.

In contrast, embodiments of the present invention relate to the formation of ceramic coatings in an alkaline electrolyte in a field of acoustic vibrations within a sonic (i.e. not ultrasonic) frequency range, the intensity of the vibrations preferably not exceeding 1 W/cm$^2$.

The acoustic vibrations may be generated by at least one aerohydrodynamic generator, which is an instrument that converts kinetic energy of a jet of liquid and air into acoustic vibration energy. Such generators are distinguished by their simplicity, reliability and economy, and comprise a fluid inlet and a resonance chamber. Acoustic vibrations are induced in the resonance chamber of the generator as the electrolyte passes through it from the fluid inlet, followed by discharge of the electrolyte, as a result of which air from atmosphere is drawn into the generator via a special channel, mixed with the electrolyte and dispersed.

Many micro-bubbles of air are caught up in the flow, filling the entire volume of the bath. The air dissolves intensively in the electrolyte and saturates it with oxygen. The gas saturation of the electrolyte increases by 20–30%.

The air bubbles, vibrating at the frequency of the acoustic vibrations, create micro-scale flows in the electrolyte, which significantly speeds up the process of agitating the electrolyte, preventing it from becoming depleted close to the surface being oxidised. The efficient removal of the heat created by the plasma discharges eliminates local overheating and ensures the formation of a good-quality ceramic coating of uniform thickness. The input of new portions of electrolyte with higher oxygen content intensifies the plasma-chemical reactions in the discharge zone and speeds up the coating formation process.

The aqueous alkaline electrolytes used for plasma oxidation consist of colloid solutions, i.e. hydrosols. Like any colloid solutions, the electrolytes are liable to coagulation, flocculation and sedimentation. When the electrolyte has reached a certain level of coagulation, flocculation and sedimentation, it becomes ineffective and the quality of the coating deteriorates sharply. Thus, the effectiveness of the electrolyte may be determined by controlling the number and size of the colloid particles.

Embodiments of the present invention enable the electrolyte to remain stable and efficient for a long time, due to the continuous breaking up of large particles that may form therein. Under the influence of the acoustic field created by the acoustic vibration generator, the rate of displacement of the colloid particles increases and the number of active collisions of particles with each other, with the walls of the bath and with the surface of the article being oxidised rises, leading to dispersal of the particles.

To produce ceramic coatings with predetermined functional properties (resistance to wear, light, corrosion and heat, dielectric, uniform colour throughout the thickness), ultra-disperse insoluble powders (nanopowders), preferably with particle size not more than 0.5 $\mu$m, in some embodiments not more than 0.3 $\mu$m, and a preferred concentration of 0.1 to 5 grams per litre, may be added to the electrolyte.

There are known processes for using solid disperse powders in electrolytic spark oxidation (GB 2237030; WO 97/03231; U.S. Pat. No. 5,616,229; RU 2038428; RU 2077612). In all these processes, the powders used have a relatively large particle size of 1 to 10 $\mu$m, and are used in relatively high concentrations of 2 to 100 grams per litre. Such particles rapidly settle; to keep them in a state of suspension, the rate of circulation of the electrolyte in the bath or the supply of air for bubbling must be increased. In doing this, it is virtually impossible to distribute the particles uniformly within the volume of the electrolyte, and thus in the coating itself. Furthermore, the large particles which have entered the oxide layers do not have time to melt, which leads to the formation of flaky weakly-caked coatings.

This invention proposes the use of nanopowders, preferably with particle size up to 0.5 $\mu$m, in some embodiments up to 0.3 $\mu$m, a developed specific surface (not less than $10^2$ per gram) and which are distinguished by their high-energy state. The electrolyte, with the powders introduced into it with the aid of the acoustic vibrations, is brought to a state of a high-disperse stable hydrosol.

The ultra-dispersed particles themselves are more resistant to coagulation and sedimentation. However, the use of acoustic vibrations causes further dispersion of the particles in the electrolyte and distributes them uniformly within the volume of the electrolyte.

The acoustic effect intensifies the mixing of the particles and imparts to them an additional quantity of energy. Due to the additional charge carried by the micro-particles (they are charged by the ions of the electrolyte), a plasma-chemical reaction is activated in the discharge zone. The ultra-disperse particles entering the plasma discharge zone are partly sublimated and partly completely melted in with the growing oxide layer, forming a dense ceramic coating. The process of forming the coating is also accelerated and may reach 2–10 $\mu$m per minute, depending on the material of the substrate. The coatings produced are characterised by high structural stability and uniformity of thickness.

The following can be used as ultra-dispersed powders (nanopowders) added to the electrolyte: oxides ($Al_2O_3$, $ZrO_2$, $CeO_2$, $CrO_3$, MgO, $SiO_2$, $TiO_2$, $Fe_2O_3$, $Y_2O_3$, and also mixtures thereof, compound oxides and spinels), borides ($ZrB_2$, $TiB_2$, $CrB_2$, $LaB_2$), nitrides ($Si_3N_4$, TiN, AlN, BN), carbides ($B_4C$, SlC, $Cr_3C_2$, TlC, ZrC, TaC, VC, WC), sulphides ($MoS_2$, $WS_2$, ZnS, CoS), silicides ($WSi_2$, $MoSi_2$) and others. The addition to the electrolyte of such refractory particles of different chemical compositions makes it possible radically to alter physico-mechanical properties of the coatings such as structure, microhardness, porosity, strength and colour. It is thus possible to produce coatings with optimum properties for a specific application.

The use of nanopowders makes it possible to achieve high quality coatings at relatively low concentrations of 0.1 to 5 grams per litre, preferably 0.5–3 g/l. No noticeable effect is produced by the use of higher concentrations or of powders with particle size greater than 0.5 $\mu$m.

One feature of this invention, discovered by the present applicant, is a considerable acceleration of the formation of a good quality ceramic coating if the oxidation process is combined with the use of high-frequency electrical pulses and the generation in the electrolyte of acoustic vibrations in the sonic frequency range. The acoustic vibration range must overlap with the current pulse frequency range. This increase in the rate of formation of the coating takes place without a significant increase in electricity consumption.

Each of the listed effects, such as raising the frequency of pulses of a specific form without an acoustic field in the electrolyte, and the generation in the electrolyte of acoustic vibrations using industrial frequency pulses, in itself leads to a rise in the productivity of the oxidation process. However, if both effects are used simultaneously, the resultant effect noticeably exceeds the simple sum of the two.

It appears that in this case there is an additional concentration of energy on the boundary of the division between the electrolyte and the surface being oxidised, and thus an acceleration of the diffusion, thermal and plasma-chemical processes during oxidation.

The device of the present invention for forming ceramic coatings on metals and alloys includes a supply source and an electrolytic bath (FIG. 2).

The supply source produces and supplies to the electrodes electrical pulses of alternating polarity. Positive and negative pulses of current can be sent alternately, one after the other or in alternating packs of pulses. The order and frequency of succession of the pulses, their duration and the current and voltage amplitudes may be regulated by a microprocessor, which controls the electrolysis process.

The electrolytic bath in turn may consist of the bath itself, made for example of stainless steel and serving as one electrode, a second electrode to which the article being oxide-coated is connected, a cooling system for the electrolyte and a system for generating acoustic vibrations. The bath may be filled with an alkaline electrolyte of pH 8.5 to 13.5.

The electrolyte cooling system may consist of a pump to pump the electrolyte, a coarse cleaning filter to trap particles of size more than 10 $\mu$m, and a cooler. The temperature of the electrolyte is preferably kept within the limits 15 to 55° C. during oxidation.

The system for generating acoustic vibrations in the electrolyte may consist of an aerohydrodynamic generator (or several of them) fitted in the bath, a pressure gauge and valves regulating the intensity of a supply of the electrolyte and air to the generator. The parameters of the acoustic field in the electrolyte are regulated by altering the pressure of the flow of the electrolyte at the input of the aerohydrodynamic generator. The generator requires virtually no additional energy and is operated by the pressure of the jet of electrolyte driven by the pump, which may provide pressure from three to seven bars.

A considerable advantage of the process of embodiments of the present invention is the fact that it makes it possible to produce dense microcrystalline ceramic coatings of thickness up to 150 $\mu$m, preferably from 2 to 150 $\mu$m, and microhardness 500 to 2100 HV on metals in a relatively short time (from a few minutes to one hour).

The coatings have low roughness, Ra 0.6 to 2.1 $\mu$m, and a very thin external porous layer, comprising not more than 14% of the total thickness of the coating. This eliminates, or significantly reduces, the need for subsequent laborious finishing of the surface (FIG. 3).

The coatings are characterised by high uniformity of thickness, even on articles of complex shape.

The highly dispersed polycrystalline ceramic coatings consist of melted globules, up to several microns in size, firmly bonded to each other. This structure produces high physico-mechanical properties in the coatings, such as resistance to wear and corrosion, and dielectric strength. Furthermore, the addition to the electrolyte of solid nanopowders of a specific chemical composition provides for targeted changes in the structure, microhardness, strength and colour of the coatings, optimising the properties of the coatings for specific application conditions.

Embodiments of the present invention enable a ceramic coating to be formed at a rate of 2 to 10 $\mu$m/min, which considerably exceeds the rate of formation of hard ceramic coatings by known prior art processes.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION

Detailed descriptions of one or more preferred embodiments are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in any appropriate system, structure or manner.

Figure 1:
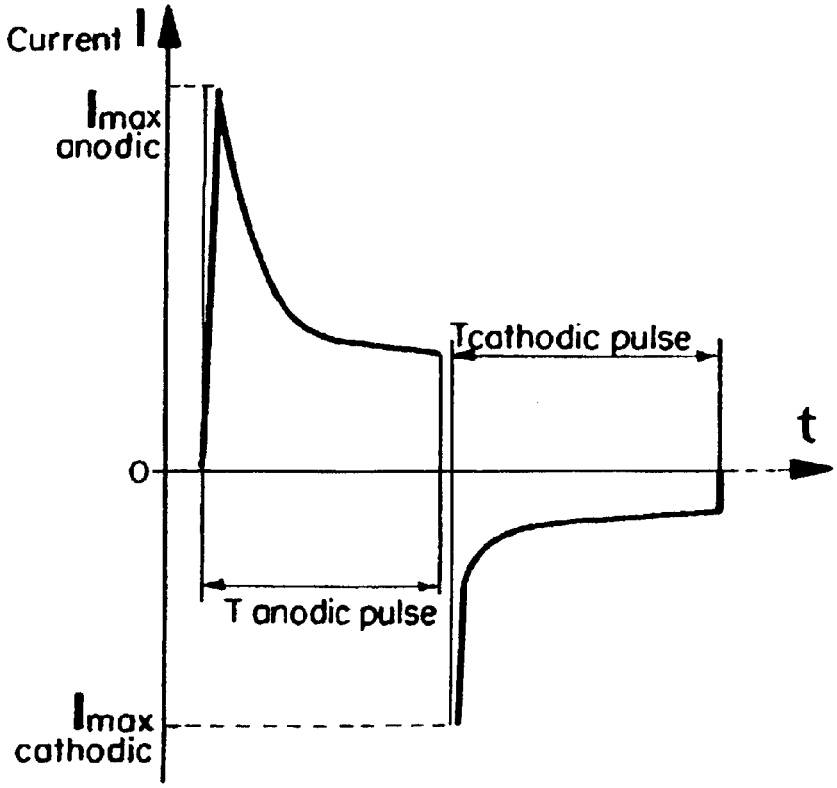
FIG. 1 shows a preferred form of the time dependence of the form of the current pulses (positive and negative) passing in the circuit between the supply source and the electrolytic bath.

FIG. 1 shows a preferred form of the time dependence of the form of the current pulses (positive and negative) passing in the circuit between the supply source and the electrolytic bath. Each current pulse has a steep front, so that the maximum amplitude is reached in not more than 10% of the total pulse duration, and the current then falls sharply, after which it gradually decreases to 50% or less of the maximum.

Figure 2:
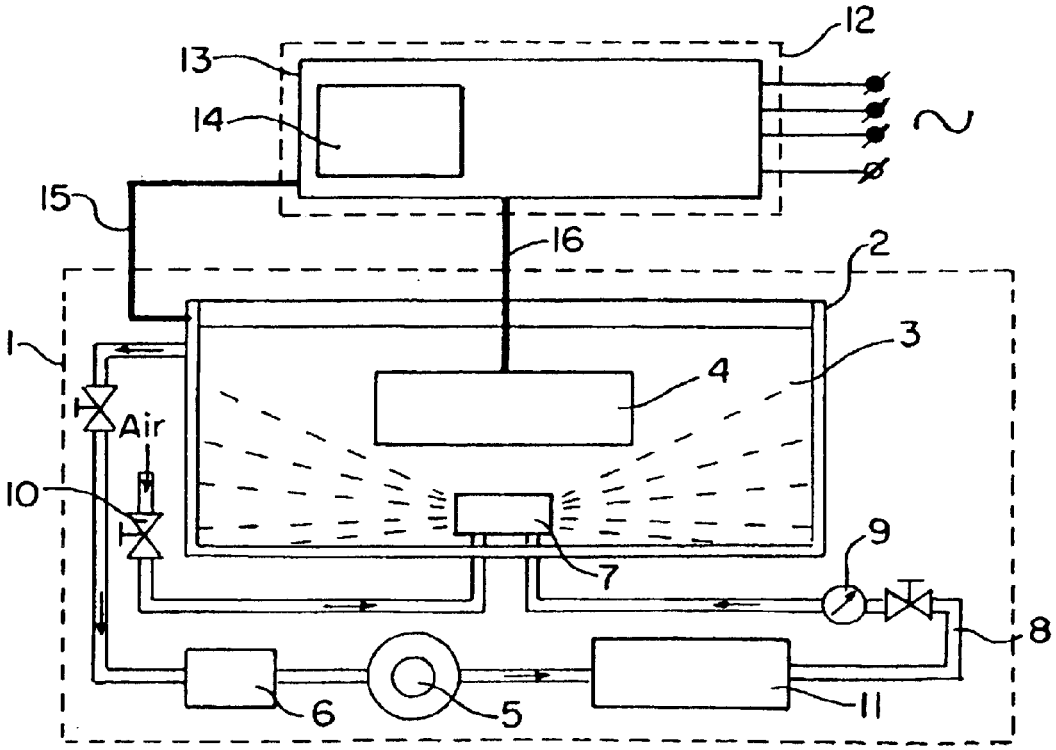
FIG. 2 shows an embodiment of the apparatus of the present invention.

As can be seen from FIG. 2, the device consists of two parts: an electrolytic bath (1) and a supply source (12), connected to each other by electrical busbars (15, 16).

The electrolytic bath (1), in turn, consists of a bath (2) of stainless steel, containing an alkaline electrolyte (3) and at least one article (4) immersed in the electrolyte. The bath is supplied with a transfer pump (5) and a filter (6) for coarse cleaning of the electrolyte.

An aerohydrodynamic generator (7) is fitted in the lower part of the bath (2). A valve (8) is provided to regulate the pressure of the electrolyte (3), and thus the frequency of the acoustic vibrations. A regulating valve (8) and a pressure gauge (9) are fitted at an input to the generator (7). A valve (10) is provided to regulate the flow rate of the air going to the generator (7). The electrolyte circulating system includes a heat exchanger or cooler (11) to maintain the required temperature of the electrolyte (3) in the course of oxidation.

The supply source (12) consists of a three-phase pulse generator (13) fitted with a microprocessor (14) controlling the electrical parameters of the oxidation process.

Figure 3:
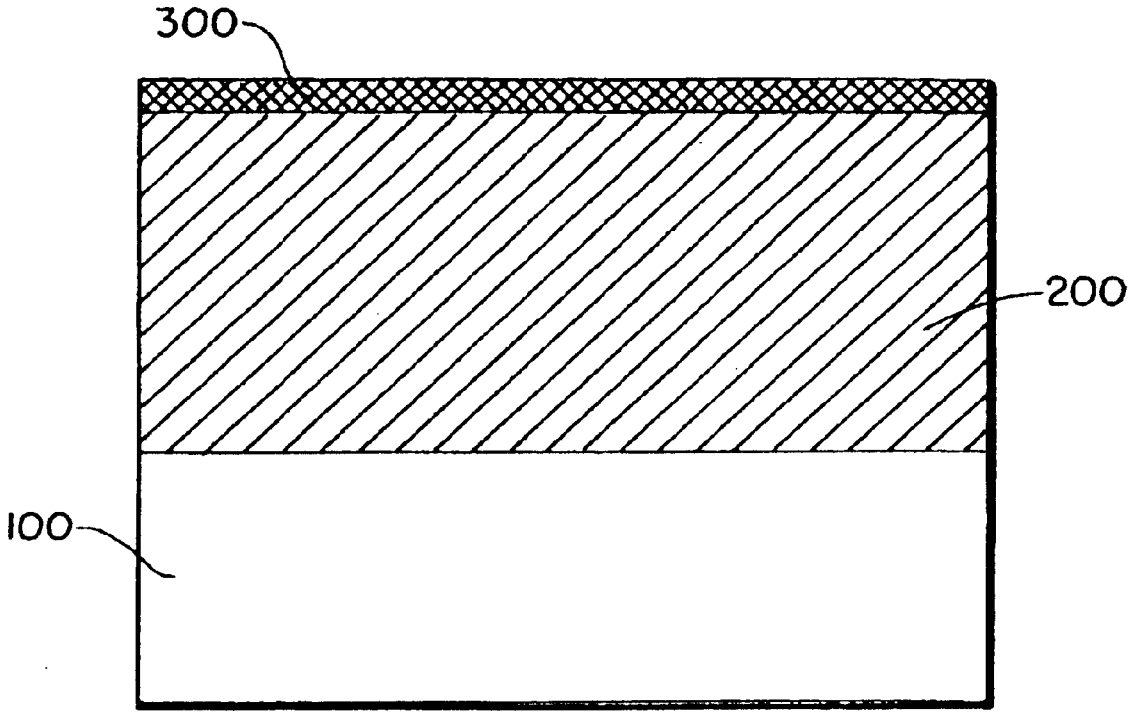
FIG. 3 shows a cross section through a ceramic coating formed in accordance with a process of the present invention.

FIG. 3 shows a cross section of a ceramic coating formed on a metal substrate (100). The ceramic coating consists of a hard functional layer (200) and a thin (less than 14% of the total coating thickness) external porous layer (300). The surface of the ceramic coating has low roughness (Ra 0.6 to 2.1 $\mu$m).

The invention is clarified by examples of the implementation of the process. In all the examples, the specimens to be coated were in the form of a disc 40 mm in diameter and 6 mm thick. The specimens were degreased before oxidation. After oxidation, the specimens were washed in de-ionised water and dried at 100° C. for 20 minutes. The electrical parameters of the process were registered by an oscilloscope. The quality parameters of the coating (thickness, microhardness and porosity) were measured from transverse micro-sections.

EXAMPLE 1

A specimen of aluminium alloy 2014 was oxidised for 35 minutes in phosphate-silicate electrolyte, pH 11, at temperature 40° C. Bipolar alternating electrical pulses of frequency 2500 Hz were supplied to the bath. The current density was 35 A/dm$^2$, and the final voltage (amplitude) was: anode 900V, cathode 400V. Acoustic vibrations were generated in the bath by an aerohydrodynamic generator. The pressure of the electrolyte at the input into the generator was 4.5 bars. A dense coating of a dark grey colour, overall thickness 130±3 $\mu$m, including an external porous layer 14 $\mu$m thick, was obtained. The roughness of the oxide-coated surface was Ra 2.1 $\mu$m, its microhardness was 1900 HV, and the porosity of the hard functional layer (not the external porous layer) was 4%.

EXAMPLE 2

A specimen of magnesium alloy AZ91 was oxidised for two minutes in a phosphate-aluminate electrolyte to which 2 g/l of ultra-disperse $Al_2O_3$ powder with particle size 0.2 $\mu$m was added. The temperature of the electrolyte was 25° C. pH 12.5. Bipolar alternating electrical pulses of frequency 10,000 Hz were supplied to the bath in turn. The current density was 10 A/dm$^2$ and the final voltage (amplitude) was: anode 520V, cathode 240V. Acoustic vibrations were generated in the bath using an aerohydrodynamic generator. The pressure of the electrolyte at the input to the generator was 4.8 bars. The coating obtained was dense, of a white colour, overall thickness 20±1 $\mu$m, including an external porous layer of thickness 2 $\mu$m. The roughness of the oxidised surface was Ra 0.8 $\mu$m, the microhardness of the coating was 600 HV, and the porosity of the functional layer was 6%.

EXAMPLE 3

A specimen of titanium alloy Ti A16 V4 was oxidised for seven minutes in a phosphate-borate electrolyte to which 2 g/l of ultra-disperse $Al_2O_3$ with particle size 0.2 $\mu$m was added. The temperature of the electrolyte was 20° C. pH 9. Bipolar alternating electrical pulses of frequency 1,000 Hz were supplied to the bath. The current density was 60 A/dm$^2$ and the final voltage (amplitude) was: anode 500V, cathode 180V. Acoustic vibrations were generated in the bath using an aerohydrodynamic generator. The pressure of the electrolyte at the input to the generator was 4.0 bars. The coating obtained was dense, of a bluish-grey colour, overall thickness 15±1$\mu$m, including an external porous layer of thickness 2 $\mu$m. The roughness of the oxidised surface was Ra 0.7 $\mu$m, the microhardness of the coating was 750 HV, and the porosity of the functional layer was 2%.

EXAMPLE 4

A specimen of AlBemet alloy, containing 38% aluminium and 62% beryllium, was oxidised for 20 minutes in a phosphate-silicate electrolyte, pH 9, at temperature 30° C. Bipolar electrical pulses of frequency 3,000 Hz were supplied to the bath. The current density was 35 A/dm$^2$ and the final voltage (amplitude) was: anode 850V, cathode 350V. Acoustic vibrations were generated in the bath using an aerohydrodynamic generator. The pressure of the electrolyte at the input to the generator was 4.5 bars. The coating obtained was dense, of a light grey colour, overall thickness 65±2 $\mu$m, including an external porous layer of thickness 8 $\mu$m. The roughness of the oxidised surface was Ra 1.2 $\mu$m, the microhardness of the coating was 900 HV, and the porosity of the functional layer was 5%.

EXAMPLE 5

A specimen of intermetallide alloy, containing 50% titanium and 50% aluminium, was oxidised for 10 minutes in a phosphate-silicate electrolyte, pH 10, at temperature 20° C. Bipolar electrical pulses (one positive and two negative) of frequency 2,000 Hz were supplied to the bath. The current density was 40 A/dm$^2$ and the final voltage (amplitude) was: anode 650V, cathode 300V. Acoustic vibrations were generated in the bath using an aerohydrodynamic generator. The pressure of the electrolyte at the input to the generator was 4.0 bars. The coating obtained was dense, of a dark grey colour, overall thickness 25±1$\mu$m, including an external porous layer of thickness 2.5 $\mu$m. The roughness of the oxidised surface was Ra 1.0 $\mu$m, the microhardness of the coating was 850 HV, and the porosity of the functional layer was 5%.

EXAMPLE 6

A specimen of intermetallide alloy, containing 95% $Ni_3Al$, was oxidised for 10 minutes in a phosphate-borate electrolyte, pH 9.5, at temperature 25° C. Bipolar electrical pulses (one positive and two negative) of frequency 1,500 Hz were supplied to the bath. The current density was 50 $A/dm^2$ and the final voltage (amplitude) was: anode 630V, cathode 260V. Acoustic vibrations were generated in the bath using an aerohydrodynamic generator. The pressure of the electrolyte at the input to the generator was 6.8 bars. The coating obtained was dense, white in colour, overall thickness 30±1 μm, including an external porous layer of thickness 3 μm. The roughness of the oxidised surface was Ra 0.9 μm, the microhardness of the coating was 700 HV, and the porosity of the functional layer was 3%.

The results of the tests described in the examples are given in Table 1. For comparison, Table 1 also includes data from a known process of oxidising with industrial-frequency currents.

TABLE 1

| | Electrolysis regime and coating characteristics | Known process WO 99/31303 | Process proposed by the invention | | | | | |
|---|---|---|---|---|---|---|---|---|
| 1 | Material being coated | Aluminum alloy 2014 | Aluminum alloy 2014 | Magnesium alloy AZ91 | Titanium alloy Ti Al6 V4 | Albemet Al 38%, Be 62% | Intermediate TiAl Ti 50%, Al 50% | Intermediate $Ni_3Al$ 95% |
| 2 | Characteristics of electrolyte | | | | | | | |
| | Composition | Phosphate-silicate | Phosphate-silicate | Phosphate-aluminate + $\gamma Al_2O_3$ (0.2 μm) - 2 g/l | Phosphate-borate + $\gamma Al_2O_3$ (0.2 μm) - 2 g/l | Phosphate-silicate | Phosphate-silicate | Phosphate-borate |
| | Temperature | 40° C. | 40° C. | 25° C. | 20° C. | 30° C. | 20° C. | 25° C. |
| 3 | Coating formation regimes | | | | | | | |
| | Electrical pulse succession frequency, Hz | 50 | 2500 | 10,000 | 1,000 | 3,000 | 2,000 | 1,500 |
| | Current density, $A/dm^2$ | 10 | 35 | 10 | 60 | 35 | 40 | 50 |
| | Final anode voltage amplitude, V | 700 | 900 | 520 | 500 | 850 | 650 | 630 |
| | Final cathode voltage amplitude, V | 320 | 400 | 240 | 180 | 350 | 300 | 260 |
| | Acoustic vibrations? | no | yes | yes | yes | yes | yes | yes |
| | Oxidation time, min. | 135 | 35 | 2 | 7 | 20 | 10 | 10 |
| 4 | Coating characteristics | | | | | | | |
| | Ceramic coating thickness, μm | 130 | 130 | 20 | 15 | 65 | 25 | 30 |
| | External porous layer thickness, μm | 39 | 14 | 2 | 2 | 8 | 2.5 | 3 |
| | Roughness Ra microns | 4.8 | 2.1 | 0.8 | 0.7 | 1.2 | 1.0 | 0.9 |
| | Microhardness, HV | 1600 | 1900 | 800 | 750 | 900 | 850 | 700 |
| | Porosity, % | 10 | 4 | 6 | 2 | 5 | 5 | 3 |

What is claimed is:

1. A process for forming ceramic coatings on metals and alloys in an electrolytic bath fitted with a first electrode and filled with aqueous alkaline electrolyte, in which is immersed the article, connected to another electrode, wherein a pulsed current is supplied across the electrodes so as to enable the process to be conducted in a plasma-discharge regime, the process comprising the steps of:

i) supplying the electrodes with high-frequency bipolar pulses of current having a predetermined frequency range; and ii) generating acoustic vibrations in the electrolyte in a predetermined sonic frequency range so that the frequency range of the acoustic vibrations overlaps with the frequency range of the current pulses.

2. A process according to claim 1, wherein the coating is formed on the metals Mg, Al, Ti, Nb, Ta, Zr, Hf and alloys thereof, and also on the compounds and composites Al—Be, Ti—Al, Ni—Ti, Ni—Al, Ti—Nb, Al—Zr, Al—Al203, Mg—A1203.

3. A process for forming ceramic coatings on metals and alloys in an electrolytic bath fitted with a first electrode and filled with aqueous alkaline electrolyte, in which is immersed the article, connected to another electrode, wherein a pulsed current is supplied across the electrodes so as to enable the process to be conducted in a plasma-discharge regime, the process comprising the steps of:

i) supplying the electrodes with high-frequency bipolar pulses of current having a predetermined frequency range; and ii) generating acoustic vibrations in the electrolyte in a predetermined sonic frequency range so that the frequency range of the acoustic vibrations overlaps with the frequency range of the current pulse, wherein each current pulse has a form comprising an initial steep increase of current to a maximum over a time that is not more than 10% of the total duration of the pulse, followed by an initially rapid and then more gradual decrease in the current to 50% or less of its maximum.

4. A process according to claim 1, wherein the acoustic vibrations cause aerohydrodynamic saturation of the electrolyte with oxygen.

5. A process according to claim 4, wherein the electrolyte is supplied with oxygen or air.

6. A process for forming ceramic coatings on metals and alloys in an electrolytic bath fitted with a first electrode and filled with aqueous alkaline electrolyte, in which is immersed the article, connected to another electrode, wherein a pulsed current is supplied across the electrodes so as to enable the process to be conducted in a plasma-discharge regime, the process comprising the steps of:

i) supplying the electrodes with high-frequency bipolar pulses of current having a predetermined frequency range; and ii) generating acoustic vibrations in the electrolyte in a predetermined sonic frequency range so that the frequency range of the acoustic vibrations overlaps with the frequency range of the current pulses, further comprising the step of introducing ultra-disperse solid particles into the electrolyte and creating a stable hydrosol by way of the acoustic vibrations.

7. A process according to claim 6, wherein the solid particles are not more than 5 $\mu$m in size.

8. A process according to claim 6, wherein the solid particles comprise compounds in the form of oxides, borides, carbides, nitrides, silicides and sulphides of metals.

9. A process according to claim 7, wherein the solid particles comprise compounds in the form of oxides, borides, carbides, nitrides, silicides and sulphides of metals.

10. A process according to claim 1, wherein the plasma discharge regime is a plasma-electrolytic oxidation regime.

11. A process according to claim 1, wherein the ceramic coating is formed at a rate of 2 to 10 $\mu$m/min.

12. A process according to claim 1, wherein the current applied to the article has a current density of 3 to 200 A/dm2.

13. A process according to claim 12, wherein the current applied to the article has a current density of 10 to 60 A/dm2.

14. A process according to claim 1, wherein the current pulses have a pulse succession frequency of at least 500 Hz.

15. A process according to claim 14, wherein the pulse succession frequency is in a range of 1,000 to 10,000 Hz.

16. A process for forming ceramic coatings on metals and alloys in an electrolytic bath fitted with a first electrode and filled with aqueous alkaline electrolyte, in which is immersed the article, connected to another electrode, wherein a pulsed current is supplied across the electrodes so as to enable the process to be conducted in a plasma-discharge regime, the process comprising:

supplying the electrodes with high-frequency bipolar pulses of current having a predetermined frequency range, wherein each current pulse has a form comprising an initial steep increase of current to a maximum over a time that is not more than 10% of the total duration of the pulse, followed by an initially rapid and then more gradual decrease in the current to 50% or less of its maximum.

* * * * *